US008602539B2

(12) United States Patent
Rittgers et al.

(10) Patent No.: US 8,602,539 B2
(45) Date of Patent: Dec. 10, 2013

(54) COLOUR PRINT CARTRIDGE

(75) Inventors: Jon Rittgers, Kildare (IE); Edward Savage, Trim (IE)

(73) Assignee: Hewlett-Packard Development Company, L.P., Houston, TX (US)

( * ) Notice: Subject to any disclaimer, the term of this patent is extended or adjusted under 35 U.S.C. 154(b) by 628 days.

(21) Appl. No.: 12/663,567

(22) PCT Filed: Jul. 25, 2008

(86) PCT No.: PCT/US2008/009062

§ 371 (c)(1),
(2), (4) Date: Dec. 8, 2009

(87) PCT Pub. No.: WO2009/017676

PCT Pub. Date: Feb. 5, 2009

(65) Prior Publication Data

US 2010/0177150 A1 Jul. 15, 2010

(30) Foreign Application Priority Data

Jul. 26, 2007 (GB) ..... 0714565.9

(51) Int. Cl.
*B41J 2/175* (2006.01)

(52) U.S. Cl.
USPC ..... 347/86; 347/87

(58) Field of Classification Search
USPC ..... 347/85, 86, 87
See application file for complete search history.

(56) References Cited

U.S. PATENT DOCUMENTS

| | | | | |
|---|---|---|---|---|
| 5,661,510 | A * | 8/1997 | Brandon et al. | 347/87 |
| 5,912,689 | A * | 6/1999 | Otsuka et al. | 347/86 |
| 6,015,210 | A * | 1/2000 | Kanematsu et al. | 347/87 |
| 6,086,193 | A * | 7/2000 | Shimada et al. | 347/86 |
| 6,331,054 | B1 | 12/2001 | Seu et al. | |
| 6,585,361 | B1 * | 7/2003 | Jones | 347/86 |
| 6,890,068 | B2 * | 5/2005 | Kawamura et al. | 347/86 |
| 7,290,871 | B2 * | 11/2007 | Greer et al. | 347/87 |
| 7,448,742 | B2 * | 11/2008 | Shaw | 347/93 |
| 7,601,210 | B2 * | 10/2009 | Fujioka et al. | 106/31.28 |

OTHER PUBLICATIONS

International Search Report, date of mailing Dec. 25, 2008 for International Application No. PCT/US2008/009062, filing date Jul. 25, 2008.

* cited by examiner

*Primary Examiner* — Anh T. N. Vo

(57) ABSTRACT

A color print cartridge comprises an ink housing 100 having a single interior compartment 250. A print head 160 mounted at the base of the housing in fluid communication with the interior of the compartment via a plurality of passageways 174, 180 in the base each having an entrance in the compartment. A single compressed block 252 of hydrophobic foam material is inserted under compression into the compartment immediately above the passageway entrances. A plurality of differently colored inks are injected into the block via respective needles 192, each ink filling a respective passageway 174, 180 and a respective region 194, 196 of the foam block above the passageway. The differently colored inks occupying non-contiguous regions within the block.

11 Claims, 5 Drawing Sheets

COLOUR PRINT CARTRIDGE

FIELD OF THE INVENTION

The present invention relates to a print cartridge.

SUMMARY OF THE INVENTION

U.S. Pat. No. 6,851,800 discloses a colour print cartridge for an desktop ink jet printer. As shown in FIG. 1, the cartridge comprises a housing 100 whose interior is divided by partitions 150, 152 into three compartments (or ink reservoirs) 106, 108 and 110, each for containing a differently coloured ink. In FIG. 1, compartments 106 and 108 are located side-by-side across the rear of the housing while compartment 110 extends across the full width of the front of the housing (in the present specification top, bottom, front, rear and like expressions refer to the orientation of the cartridge shown in the drawings).

A print head die 160 is attached to the base of the print cartridge housing 100. The print head 160 includes slots which align with outlet ports 120, 130 and 140 in the base of the housing 100. The bottom of the compartment 106 includes an exit port 170 that opens into a cavity 172 of the housing 100 to provide fluid communication between the interior of the compartment 106 and the print head 160 via the outlet port 130. Similarly, the compartment 110 is in fluid communication with the print head 160 via a cavity 182 and the outlet port 140, FIG. 2, and the compartment 110 is in fluid communication with the print head 160 via a cavity (not shown but similar to cavities 172, 182) and the outlet port 120.

A duct (or standpipe) 174 located within the compartment 106 is connected to the exit port 170, FIG. 1. The entrance to the standpipe 174 is above the bottom of the compartment 106. The standpipe 174 constitutes the only exit from the compartment 106 to the print head 160. Similar standpipes 178, 180 for compartments 108, 110 respectively can be seen in FIG. 2, each having an entrance above the bottom of the respective compartment and constituting the only exit from the compartment to the print head 160. Respective filters (not shown) are fitted over the entrance to each standpipe.

In order to charge the cartridge with ink, a respective foam block (not shown in FIGS. 1 and 2) is pre-compressed and push fitted into each compartment 106, 108, 110. Each block is generally rectangular and conforms closely to the side walls of the respective compartment. The bottom surface of each block sits on top of a respective standpipe filter and defines a free space (herein referred to as a snout region) laterally adjacent each standpipe at the bottom of each compartment. In FIG. 2 the snout regions for compartments 108, 110 are indicated by numerals 188, 190 respectively.

Before charging the cartridge, a lid (not shown in FIGS. 1 and 2 but similar to the lid 166 shown in the embodiment of FIG. 5) is fitted to the top of the housing 100. Within the lid 166 at least one hole 167 is formed in register with each standpipe. The cartridge is subjected to a vacuum with air being drawn downwardly through the compartments from the base of the housing through their respective standpipes. Respective ink dispensing needles (not shown in FIGS. 1 and 2) are introduced through the holes in the lid into the body of the foam blocks filling the compartments. Typically, the foam employed is polyurethane which is strongly hydrophobic when dry. Ink dispensed by the needles is therefore forced into the foam and the ink expands outwardly and downwardly within the foam until the ink meets an outside surface of the foam block. Typically, the ink will first meet the underside of the foam block above the standpipe, at which time the ink will tend to be drawn into and fill the standpipe and associated cavity before spreading further into the foam. Thereafter, the ink settles and spreads out in the compartment and, if enough ink is injected, will ultimately meet the internal sidewalls of the compartment as well as fill the snout region.

Once the ink has been dispensed, the needles are withdrawn, and the cartridge is removed from the vacuum. The holes in the lid may be covered, for example with a label, although they should not be sealed so that they can act as air vents to allow ink to be drawn downwardly from the compartments during use of the cartridge.

Recently, there has been a demand to supply ink cartridges of a given format (i.e. exterior size and shape) with varying levels of ink capacity. So, for example, more intense printer users may wish to purchase high capacity cartridges for their printer containing, for example, 8 ml of ink per compartment, whereas low use users may wish to purchase low capacity cartridges containing, for example, 1 ml of ink per compartment for the same model of printer. Heretofore, colour print cartridges with different ink capacities have been manufactured simply by injecting different quantities of ink into each compartment 106, 108 and 110. Thus, for high capacity cartridges substantially the entire volume of each compartment is filled with ink. However, for low capacity cartridges, in each compartment ink is injected only into a limited region of the respective foam block adjacent the standpipe entrance.

A disadvantage of this cartridge is that several foam blocks are required and each of these must be placed in a respective compartment prior to filling the cartridge. While the blocks for compartments 106 and 108 may be the same size, the block for compartment 110 may be a different shape leading to a relatively high part count for fabricating the cartridge.

According to the present invention there is provided a print cartridge as claimed in claim 1.

The invention enables relatively low capacity cartridges to be produced with a minimal part count and with a simplified manufacturing process.

Also, the number of foam to plastic wall interfaces is smaller and hence reduces the probability of reliability defects that occur at these boundaries such as foam curling.

Furthermore, the compression of the foam and the effective capillary radius is the same across all ink chambers, thus reducing backpressure variation and its impact on print quality and ink efficiency.

BRIEF DESCRIPTION OF THE DRAWINGS

An embodiment of the invention will now be described, by way of example, with reference to the accompanying drawings, in which.

DETAILED DESCRIPTION OF THE INVENTION

Figure 1:
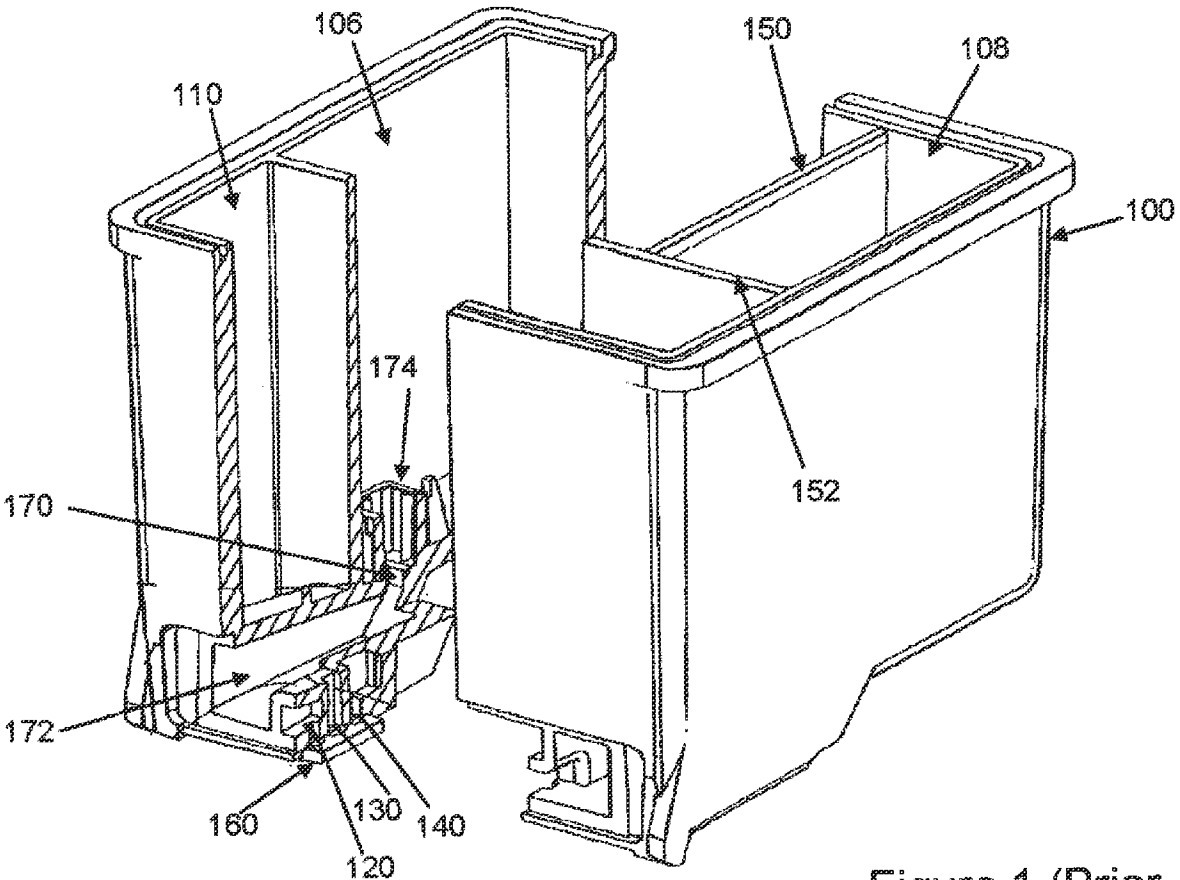
Figure 1 (Prior Art)
FIG. 1 is a perspective view of a conventional print cartridge.
Figure 2:
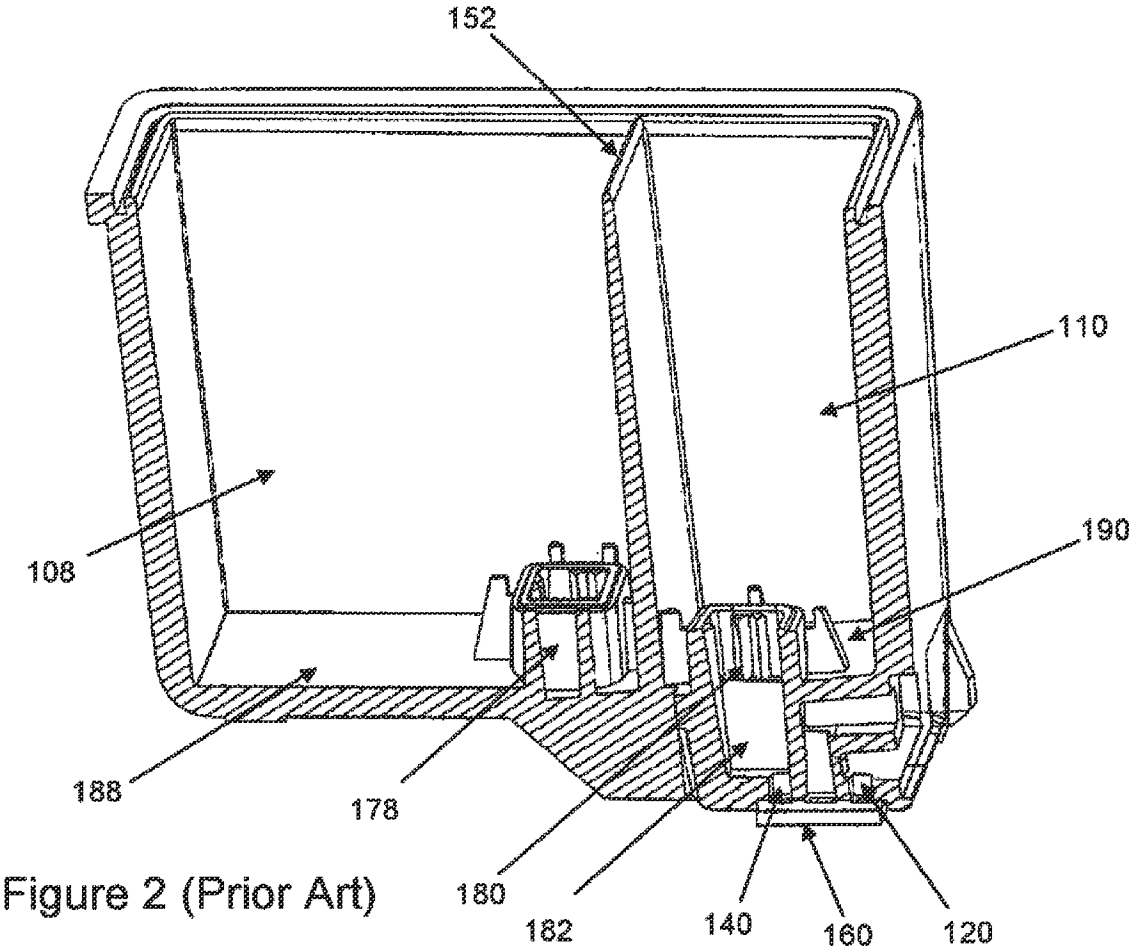
Figure 2 (Prior Art)
FIG. 2 is a perspective view of a front-to-rear section of the print cartridge of FIG. 1.

In the drawings the same reference numerals are used for the same or equivalent parts in the prior art and the embodiment. Only the differences between the embodiment and prior art will be described.

Figure 3:
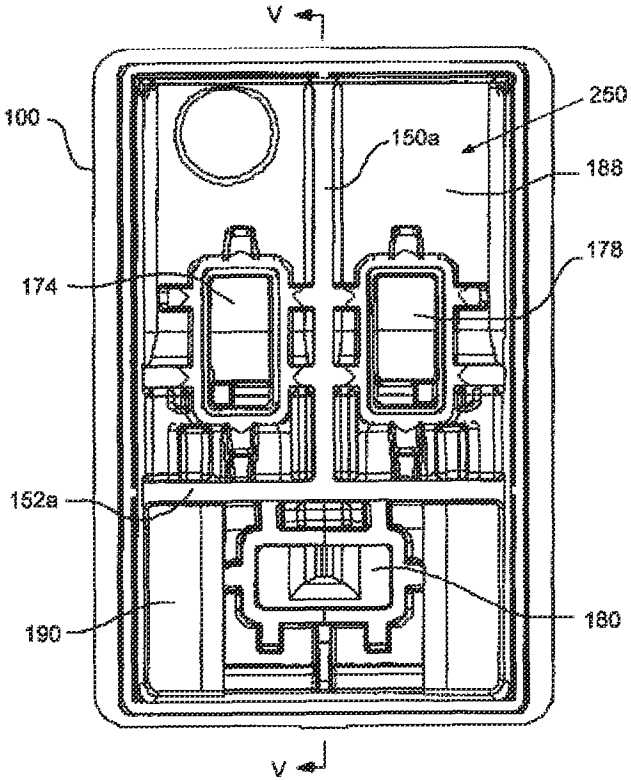
FIG. 3 is plan view of a housing for a low capacity print cartridge according to an embodiment of the invention.
Figure 4:
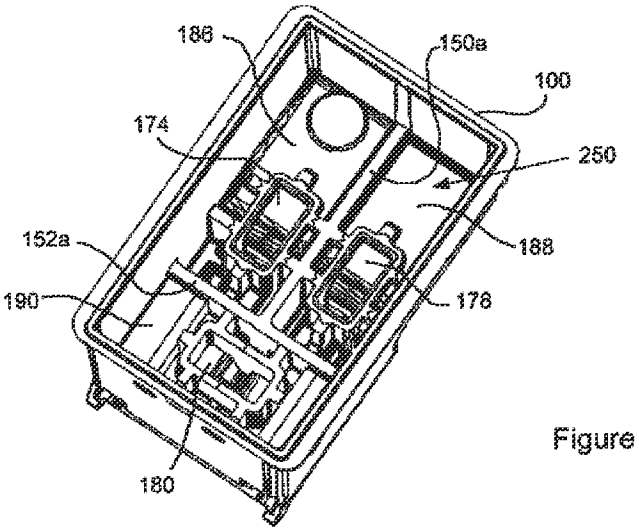
FIG. 4 is top perspective view of the print cartridge housing of FIG. 3.
Figure 5:
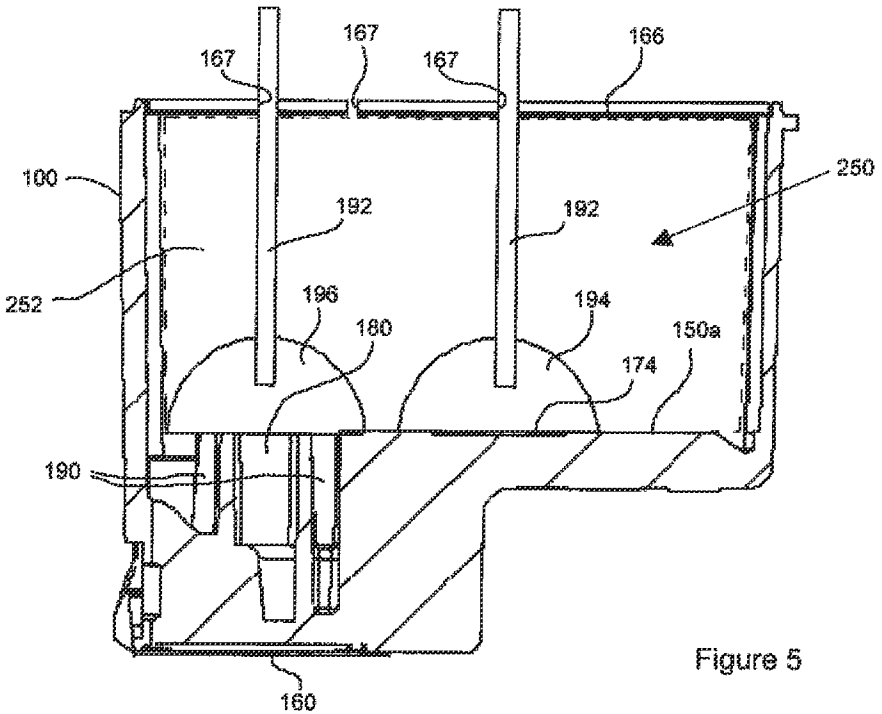
FIG. 5 is a vertical cross-section of the low capacity print cartridge according to the embodiment of the invention, taken on line V-V of FIG. 3.

Referring now to the embodiment of the invention shown in FIGS. 3 to 5, the principle difference from the prior art is that the entrances to the standpipes 174, 178, 180 are at substantially the same height within the housing 100 and the partitions 150, 152 have been replaced by low walls 150*a*, 152*a* extending upwardly from the bottom of the compartment to substantially the same height as the entrances to the standpipes. This structure defines a single interior compartment 250 within the housing 100 rather than, as before, three separate compartments 106, 108 and 110, and all three standpipes have entrances in this single compartment 250.

In addition, the cartridge now comprises only a single block 252 of hydrophobic foam material. The block 252 is inserted under compression into the compartment 250 and is dimensioned to substantially fill the compartment 250 above the entrances to the standpipes 174, 178 and 180, the lower surface of the block being immediately above and preferably in contact with the entrances to the standpipes. As before, a free space or snout region 186, 188, 190 is located laterally adjacent to each standpipe 174, 178, 180 respectively.

To charge the cartridge with ink, the cartridge is first subjected to a vacuum with air being drawn downwardly through the compartment 250 from the base of the housing through the three standpipes. Respective ink dispensing needles 192 (only the needles for the standpipes 174 and 180 are shown in FIG. 5) are introduced through the holes 167 in the lid into the body of the foam block 252. Each needle terminates in the foam block centrally above a respective standpipe entrance. Ink is injected into the block 252 through the needles 192, each needle dispensing a differently coloured ink. The ink dispensed by each needle is forced into the foam block and expands outwardly and downwardly within the foam until the ink meets the underside of the foam block above a respective standpipe, at which time the ink will tend to be drawn into and fill the standpipe and associated snout region.

However, the amount of ink injected by each needle 192 is precisely controlled to ensure that the differently coloured regions of ink injected by the needles do not meet in the block but remain as separate, non-contiguous regions—see, for example, the regions of ink 194, 196 dispensed into the foam block above the standpipes 174, 180. By this means it is possible to have several differently coloured inks dispensed into a common foam block, since the dry foam is strongly hydrophobic and the inks will not spread outwardly in the block of their own accord.

Although a respective single, centrally positioned needle 192 is used in the above embodiment to inject the ink into a region of the foam block above each standpipe, it is possible to use two injection needles, offset from the centre of the standpipe, to inject each region of ink. The use of two needles to dispense a single region of ink above a respective standpipe is described in our co-pending UK application no. 0708268.8 filed 30 Apr. 2007 (Ref: ID200603680-1).

The invention is not limited to the embodiment described herein but can be amended or modified without departing from the scope of the present invention.

The invention claimed is:

1. A print cartridge comprising an ink housing and a plurality of differently coloured printing inks occupying non-contiguous regions within a single block of hydrophobic foam material in the housing.

2. A print cartridge comprising an ink housing having a top and a base and an interior compartment, a print head mounted at the base of the housing in fluid communication with the interior of the compartment via a plurality of passageways in the base each having an entrance in the compartment, a compressed single block of hydrophobic foam material in the compartment immediately above the passageway entrances, and a plurality of differently coloured inks each filling a respective passageway and a respective region of the foam block above the passageway, the differently coloured inks occupying noncontiguous regions within the block.

3. A print cartridge as claimed in claim 2, wherein each passageway has an entrance above the bottom of the compartment, the entrances being partitioned off from one another by low walls extending upwardly from the bottom of the compartment, wherein the compressed foam block above the passageway entrances leaves a free space laterally adjacent to each passageway, and wherein the differently coloured inks further fill the free space adjacent to each passageway.

4. A print cartridge as claimed in claim 2 or 3, wherein the compartment is closed by a cover at the top of the housing, the cover having at least one air vent.

5. A method of making a print cartridge comprising providing an ink housing having a top and a base and an interior compartment, the housing further having a plurality of passageways in the base each having an entrance in the compartment to allow fluid communication between the interior of the compartment and a print head mounted at the base of the housing, inserting a single block of hydrophobic foam material into the compartment immediately above the passageway entrances, and injecting a plurality of differently coloured inks into the foam block such that each ink fills a respective passageway and a respective region of the foam block above the passageway, the differently coloured inks occupying non-contiguous regions within the block.

6. A method as claimed in claim 5, further comprising compressing the foam block.

7. A print cartridge comprising:

a housing defining a single interior compartment;

a plurality of passageways each having an opening to the interior compartment; and partition walls between the passageways, the partition walls extending to a height within the housing substantially equal to a height of each opening to form a free ink space below the interior compartment laterally adjacent to each passageway.

8. A print cartridge as claimed in claim 7, further comprising a single block of foam in the interior compartment covering the opening to each passageway.

9. A print cartridge as claimed in claim 8, further comprising a plurality of inks each occupying a respective region of the foam block covering the opening to one of the passageways and not overlapping the region occupied by any other ink.

10. A print cartridge as claimed in claim 7, further comprising:

a capillary material in the interior compartment covering the opening to each passageway; and a plurality of inks each occupying a respective region of the capillary material covering the opening to a passageway and not overlapping the region occupied by any other ink.

11. A print cartridge as claimed in claim 10, wherein the capillary material comprises a single block of foam.

* * * * *